United States Patent [19]

Yoneda et al.

[11] 4,039,049

[45] Aug. 2, 1977

[54] ELEVATOR CAR CALL SELECTION APPARATUS

[75] Inventors: Kennzi Yoneda; Takeo Yuminaka, both of Katsuta; Masao Takizawa, Kashiwa, all of Japan

[73] Assignee: Hitachi, Ltd., Japan

[21] Appl. No.: 531,160

[22] Filed: Dec. 9, 1974

[30] Foreign Application Priority Data

Dec. 12, 1973 Japan ..... 48-137711
June 7, 1974 Japan ..... 49-64093

[51] Int. Cl.[2] ..... B66B 1/30
[52] U.S. Cl. ..... 187/29 R
[58] Field of Search ..... 187/29

[56] References Cited

U.S. PATENT DOCUMENTS

| | | | |
|---|---|---|---|
| 3,589,474 | 6/1971 | Wavre | 187/29 |
| 3,743,055 | 7/1973 | Hoelscher et al. | 187/29 |
| 3,777,855 | 12/1973 | Boyldew et al. | 187/29 |

*Primary Examiner*—James R. Scott
*Assistant Examiner*—W. E. Duncanson, Jr.
*Attorney, Agent, or Firm*—Craig & Antonelli

[57] ABSTRACT

An elevator car call selection apparatus is disclosed in which in order for at least a car covering a plurality of floors to serve at least a hall call or cage call, an advance position where said car in travel is capable of stopping by deceleration and the presence or absence of the call at an advance floor corresponding to the advance position are detected, so that the floor to be next served by the car is decided in response to a call generated at the advance floor. In order to calculate the advance floor with an electronic circuit and detect a call to be next served according to the result of the calculation, the apparatus comprises means preset to produce step signals at time points when the advance floor is advanced progressively after the starting of the car. The signal representing the car-starting floor and the step signal are used to calculate the advance floor progressively advanced after the starting of the car, so that when a call is generated for a floor corresponding to the advance floor, that particular floor is determined as a floor to be next served by the car.

8 Claims, 19 Drawing Figures

ELEVATOR CAR CALL SELECTION APPARATUS

Figures 1A, 1B:
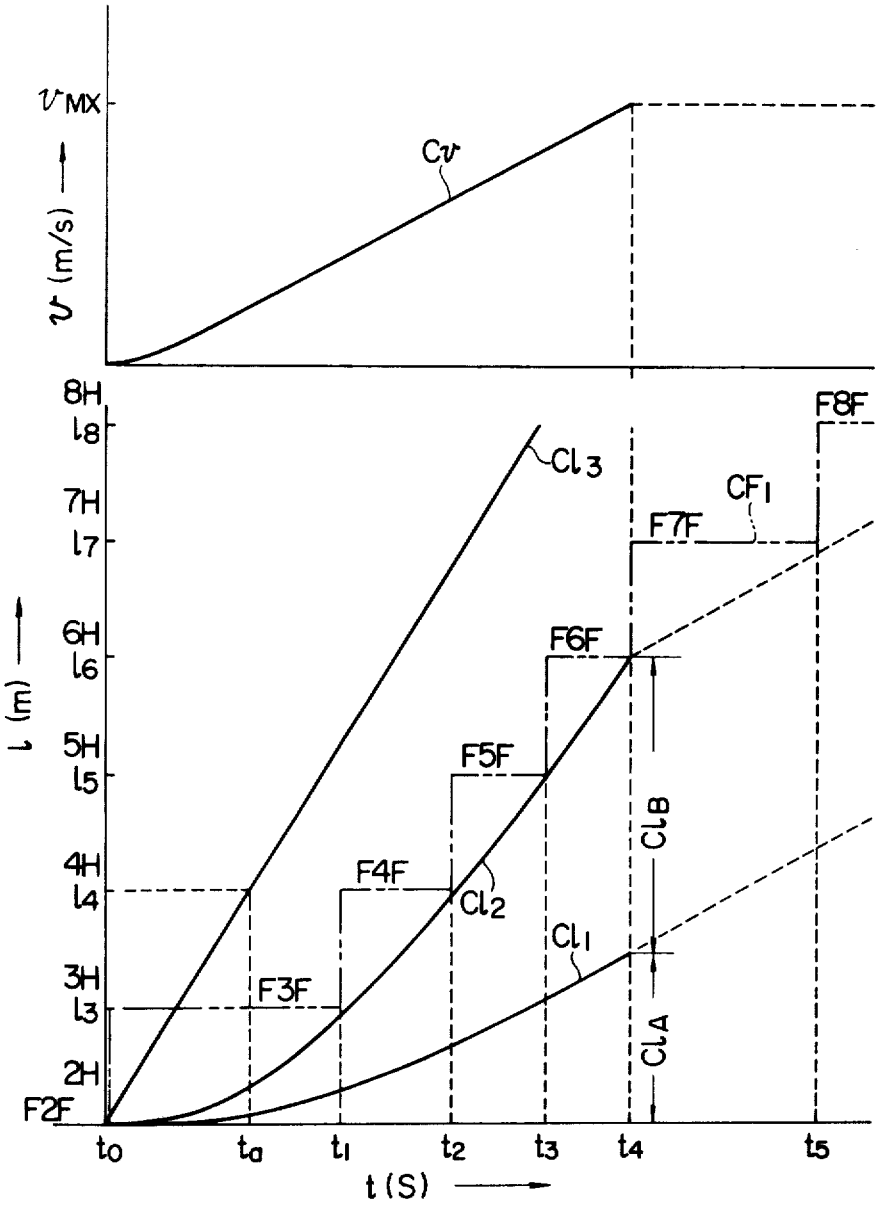

The present invention relates to an elevator call selection apparatus for detecting a hall call or cage call to be served by an elevator car after it has started.

Generally, the operation and control of an elevator car requires a driving means for driving the car and a control means for controlling the driving means. Also, it is necessary to relate the running condition of the car to the floor at which a hall call or cage call is generated in order for the car to serve the call. When a hall call is generated at a floor other than that at which the car is staying, for example, the direction of car travel determined is toward that particular floor. In this case, however, which floor is to be served first after starting of the car is not determined before the starting, since if it is decided before the starting that the floor at which the hall call has been generated is to be next served after the starting of the car, another call which might be generated before that particular floor cannot be served in spite of the car passing the floor. Therefore, the service of the car to a call is required to be always determined in relation to the position of the running car and its running condition. In other words, it is detected whether there is a call or not at a floor in advance of and closest to a position where the car can successfully stop if it is immediately decelerated (hereinafter referred to as an advance position) and this information is detected during the running of the car, so that when the advance position coincides with a floor generating a call, it is decided whether or not that particular floor should be served. This is equivalent to saying that during the running of a car, the car is detecting the presence or absence of a call at a position leading the actual position of the car by the distance required for the car to decelerate and stop. This distance required for the car to decelerate and stop is dependent on the velocity of the running car, as will be described more in detail later.

In the conventional elevator control apparatuses, a floor generating a hall call or cage call to be first served by a car after it has started is selected by the use of a mechanical selector having a moving member, i.e. synchronizer on a synchronously reduced scale of the car motion. This system is such that the car motion is reduced to a required synchronous velocity by reducing gears, an output gear of which is used to drive a chain provided within the call selector. The synchronizer is interlocked with the chain so as to move in synchronism with the car in the same direction as the car at a reduced speed. The mechanical selector is further provided with another moving member, i.e. an advancer which moves in advance of the synchronizer to select a floor generating a call which as to be served next. As mentioned above, the advancer moves in advance of the synchronizer in the direction of car travel after the car has started. In other words, after the car has started, the advancer moves in advance of the synchronizer at least by the distance required for the car to decelerate to a stop. Along the paths of travel of the synchronizer and the advancer, there are disposed a plurality of position detectors at positions corresponding to the floors involved. The position detectors enable the positions of the car and an advance position to be detected by detecting the positions of the synchronizer and the advancer. The advancer is driven by a motor and begins to run in advance of the synchronizer as soon as the car starts in order to detect a floor at which a hall call is generated and which is to be next served by the car. When the advancer detects a floor generating a call to be served by the car, it stops at a corresponding position and issues a command designating a floor to be next served by the car. This command is applied to a control device for the car driving motor, which is so controlled as to control the car to stop at that particular floor.

It will be understood that the conventional call selector comprises a direct reduction of car motion on the basis of which various signals are detected. All the systems to achieve this purpose are constructed mechanically and therefore have the following disadvantages:

1. The driving of the synchronizer and the advancer and the mounting of the position detectors corresponding to the floors involved result in a complicated mechanical construction as well as high cost.
2. With passage of time, the wearing and displacement of a great number of moving members leads to reduced precision.
3. In proportion to the number of floors involved, the distance to be covered by the synchronizer and the advancer is necessarily lengthened and more position detectors are required, thereby making the apparatus bulky.
4. In view of the need to have a margin of detection accuracy taking into consideration the wear and the like mentioned in paragraph (2) above, the efficiency of detection of an advance position is very much deteriorated, often giving rise to a deteriorated operating efficiency and service of the car.

The above-mentioned disadvantages pose a great problem at a time when buildings are rising higher and elevator cars are required to run at higher speed than ever before. As an example, an increased number of floors involved in a high-rise building results in a very bulky call selector. The elevator machine room, in which a call selector is usually disposed, can no longer accomodate such a large call selector mainly due to its height.

Accordingly, it is an object of the present invention to provide an elevator car call selection apparatus comprising electrical circuits which replace the conventional mechanical call selector and which is small in size, simple in construction and low in cost without regard to the number of service floors of a building to be served.

Another object of the invention is to provide a call selection apparatus which is capable of detecting with high efficiency a call to be next served taking into consideration the then running condition of the car, thus improving the car operating efficiency.

According to one aspect of the invention, considering the fact that an advance position of a car has a certain relation with the length of time that has lapsed after its starting and the fact that instead of the continuous advance position signal, an advance floor signal not lagging behind the advance position signal may be used to detect a call to be next served, there is provided a completely electrically-operated call selection apparatus comprising means preset for generating a step signal not later than a time point when the advance position of a car passes each floor after its starting, means for electrically calculating the advance floor signal by the use of a signal representing the floor at which the car has started and a step signal generated by step signal generator means, memory means for storing call signals, and means for detecting a call to be next served by the use of the advance floor signal and a call signal read out of the memory means.

According to another aspect of the invention, there is provided a call selection apparatus having no mechanically moving parts and therefore not accompanied by any wear or displacement. By setting the generation of the step signal at desired time points, the call detecting ability of the apparatus can be adjusted as desired, so that by presetting the apparatus to produce a step signal about the time when the advance position passes each floor, it is possible to calculate an optimum advance floor signal.

Figure 2:
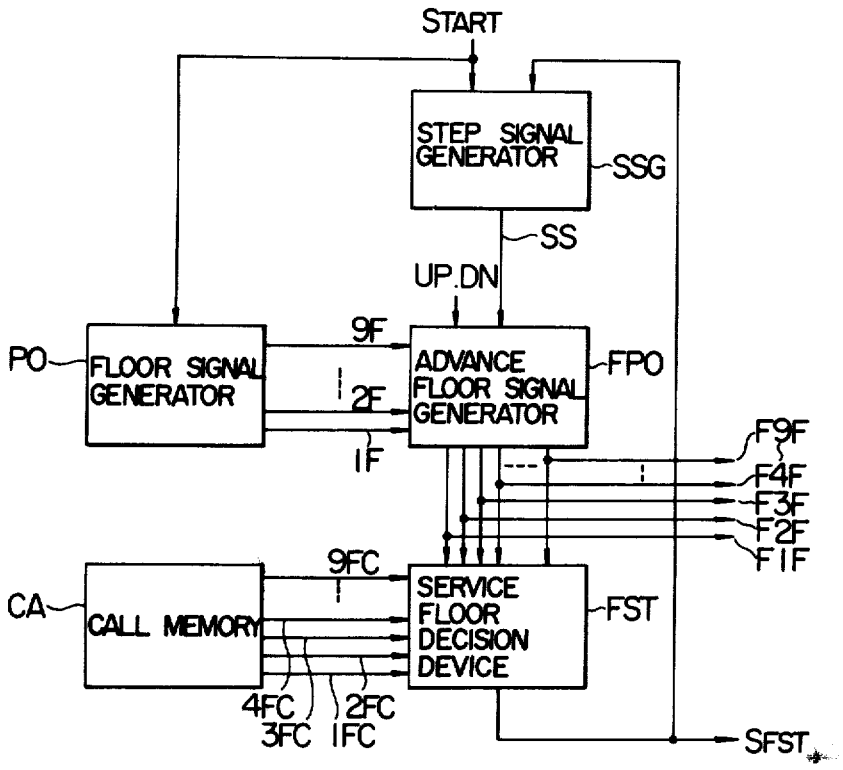
Figure 3A:
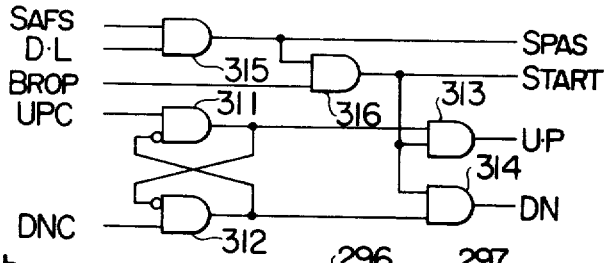
Figure 3B:
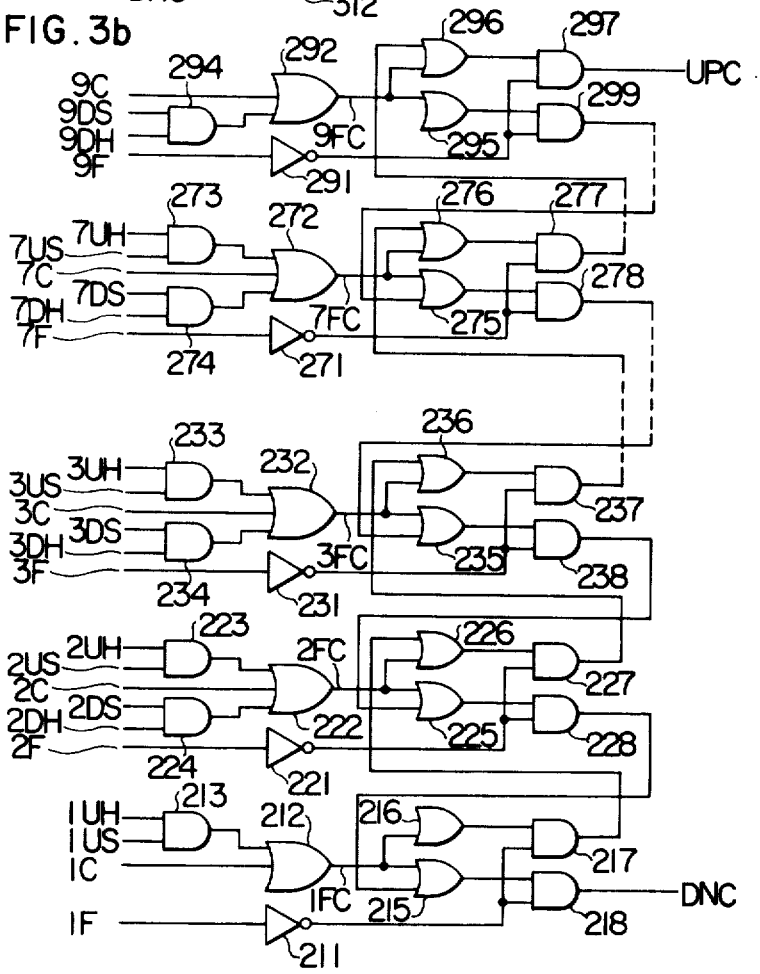
Figure 4:
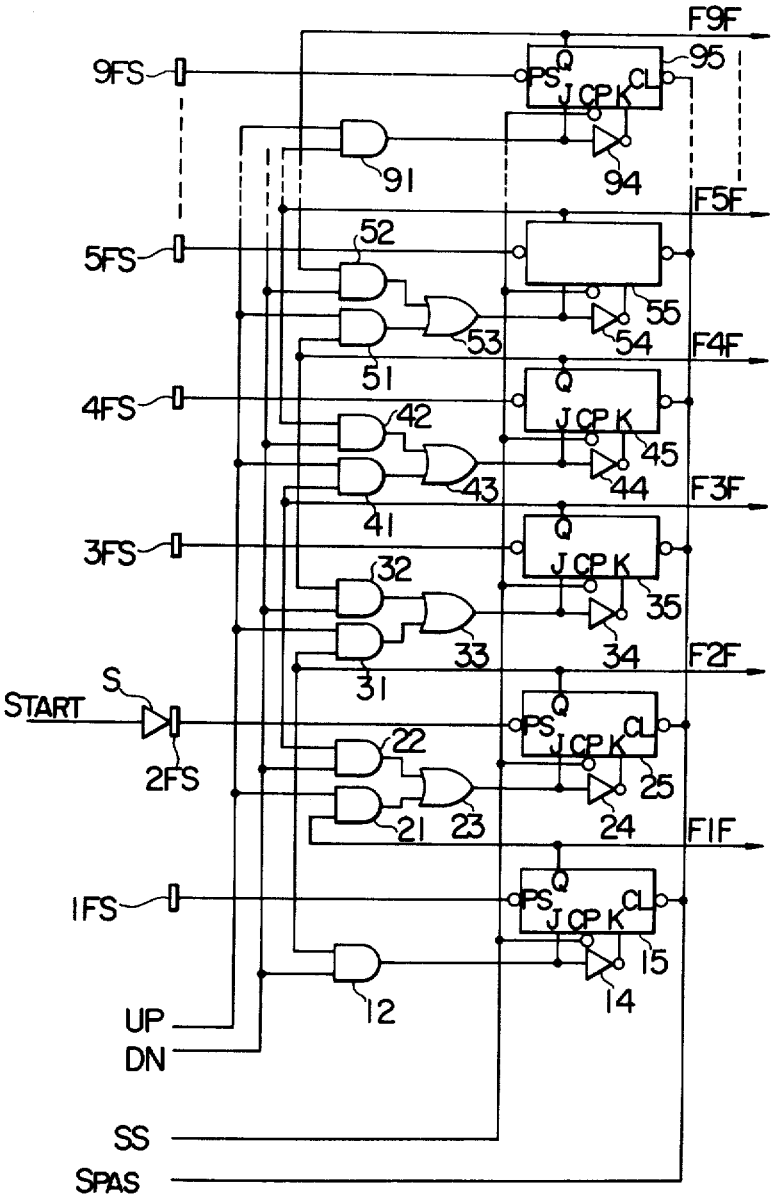
Figure 5:
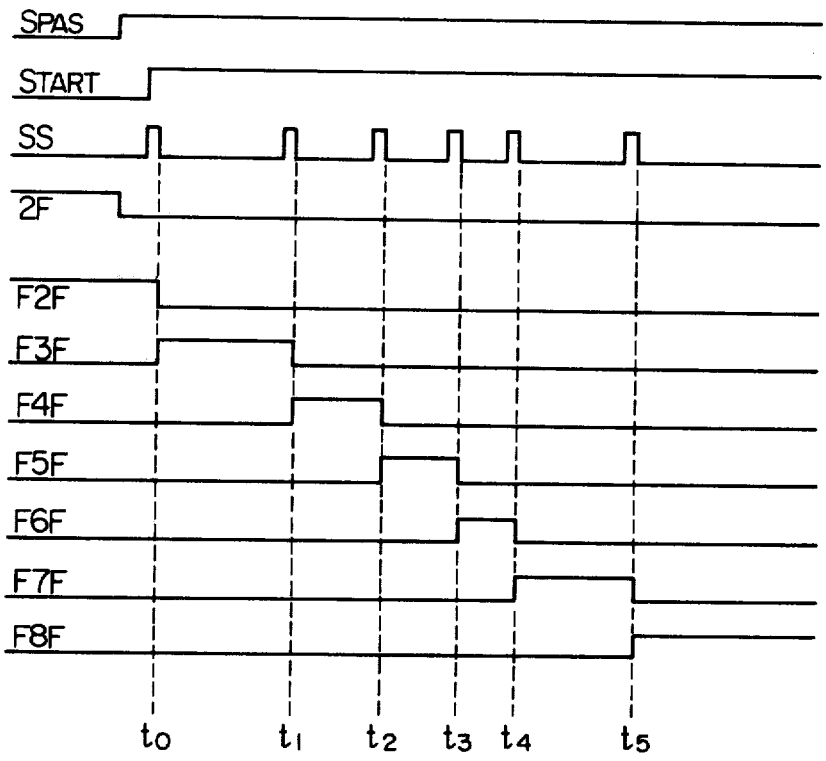
Figure 6:
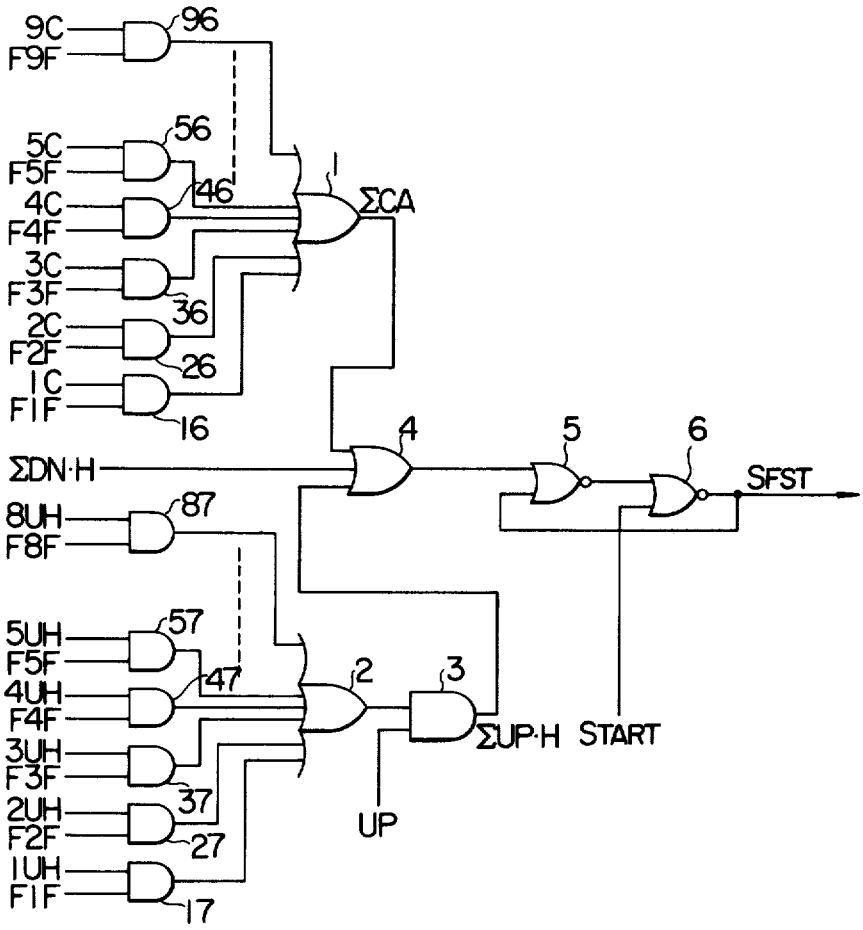
Figure 7:
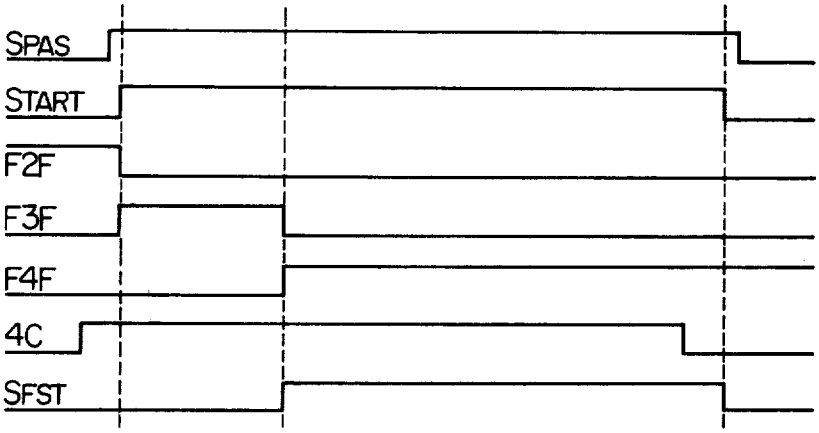
Figure 9:
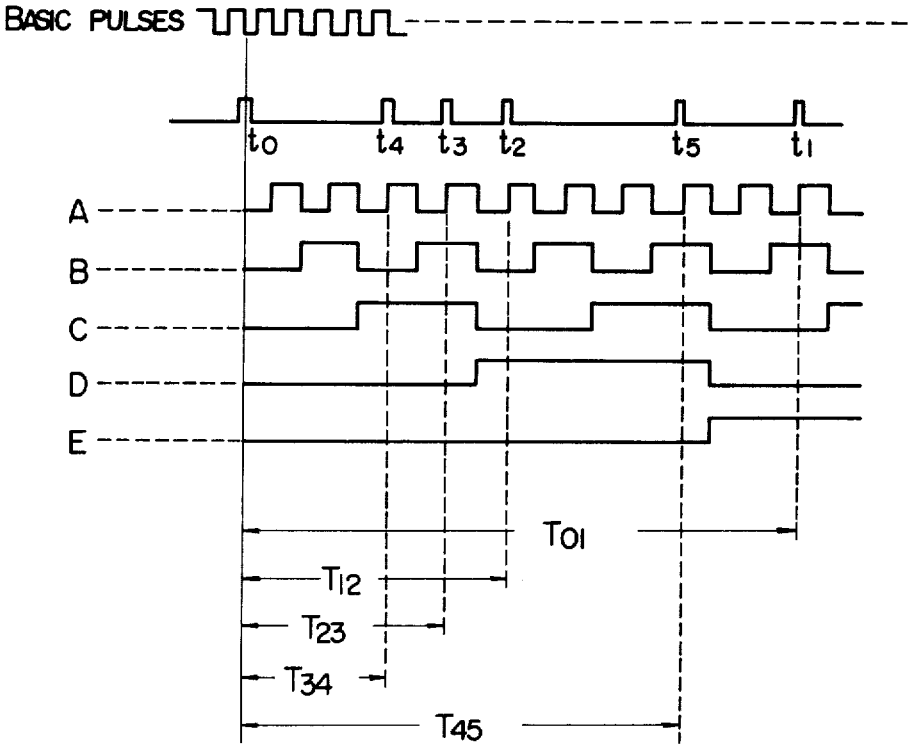
Figure 8A:
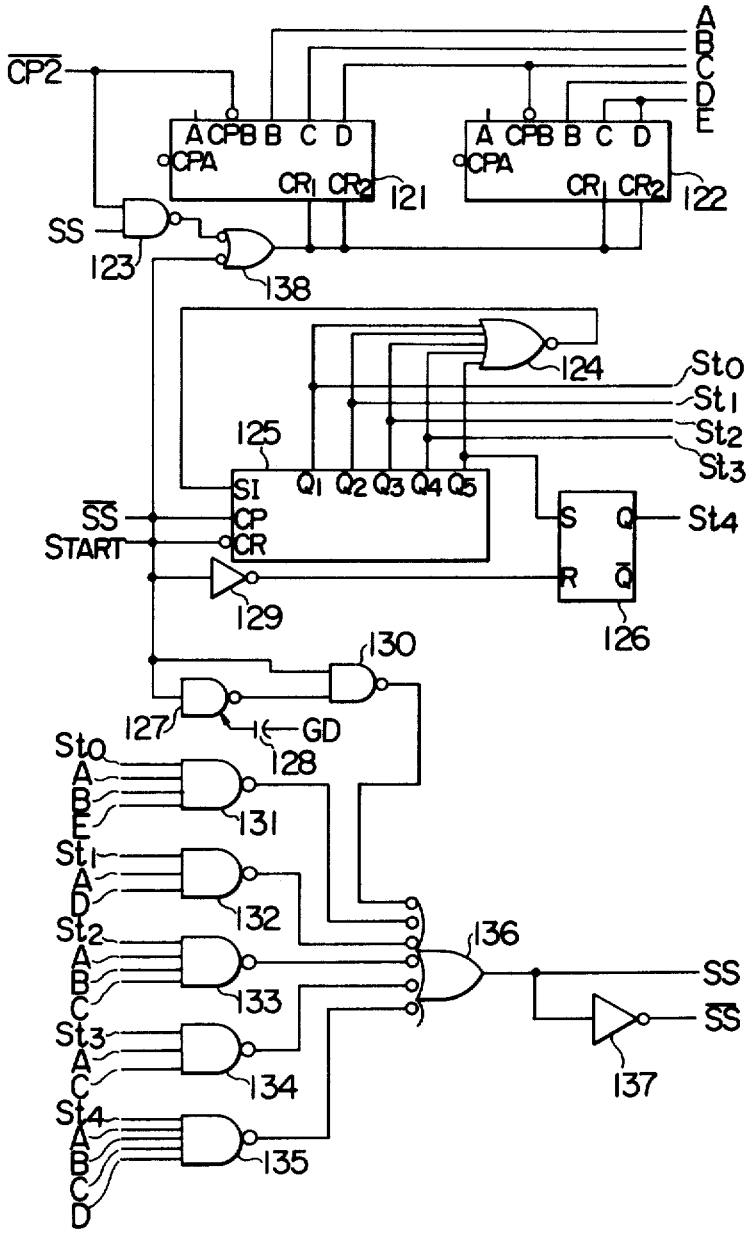
Figure 8B:
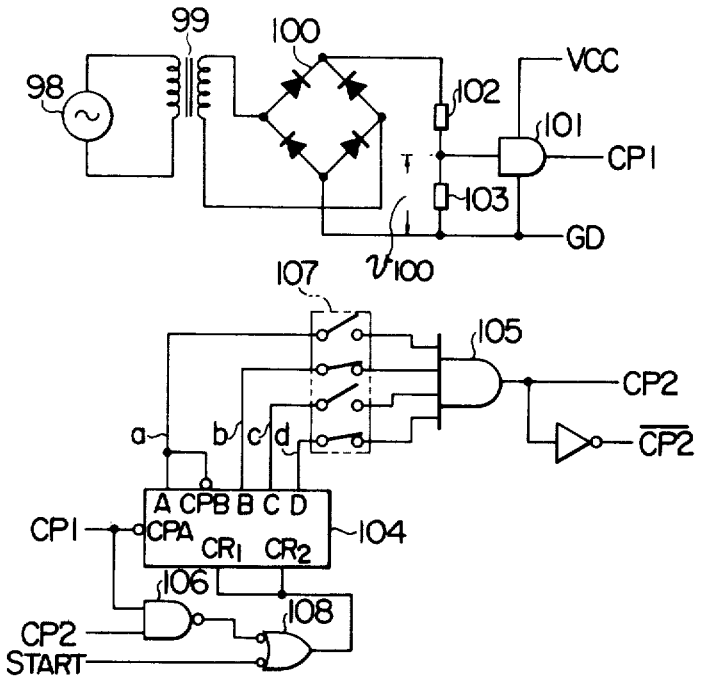
Figure 10:
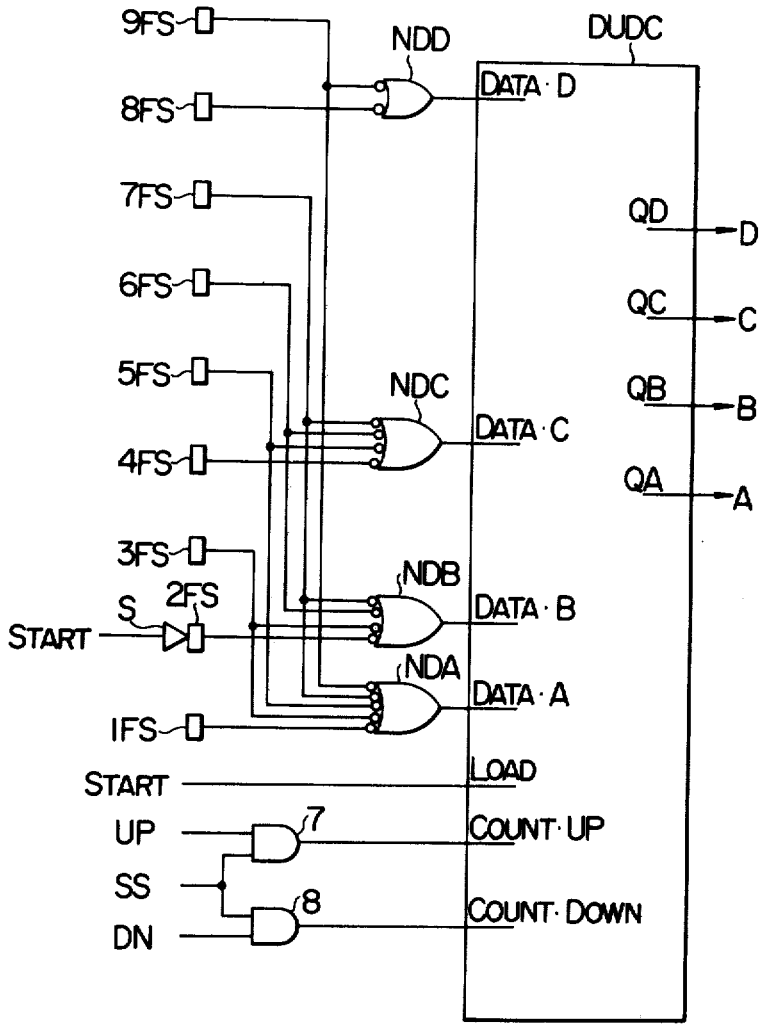
Figure 11:
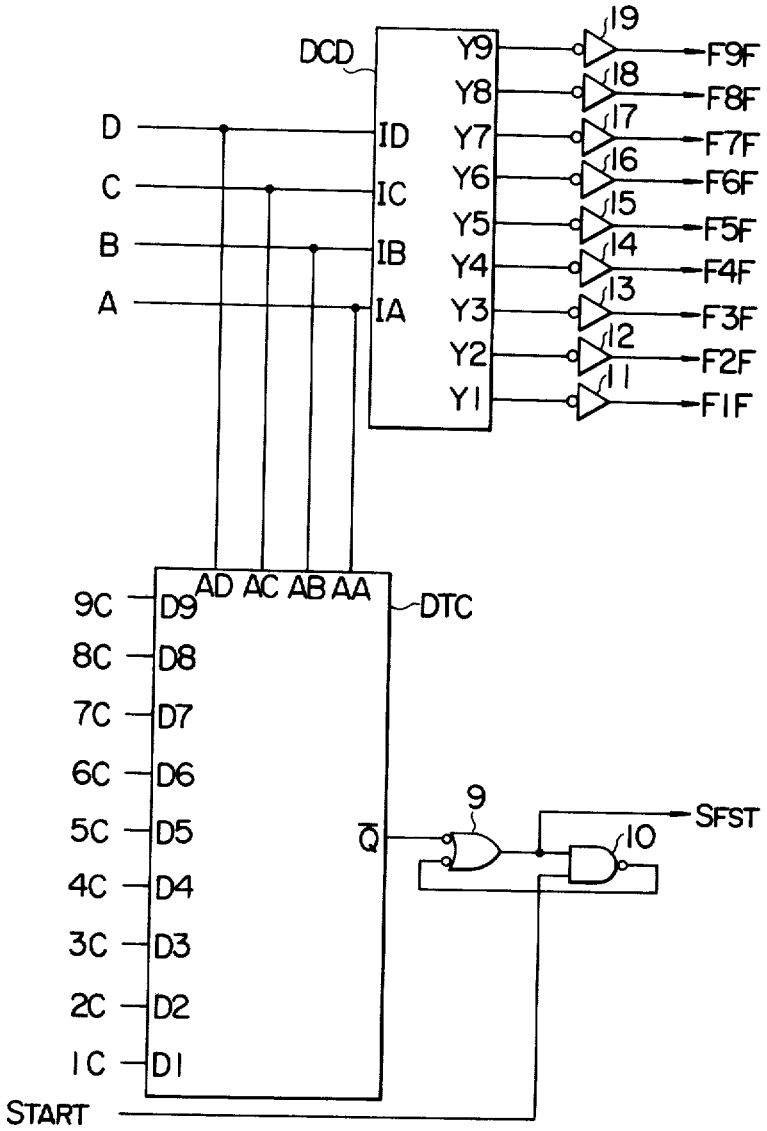
Figure 12:
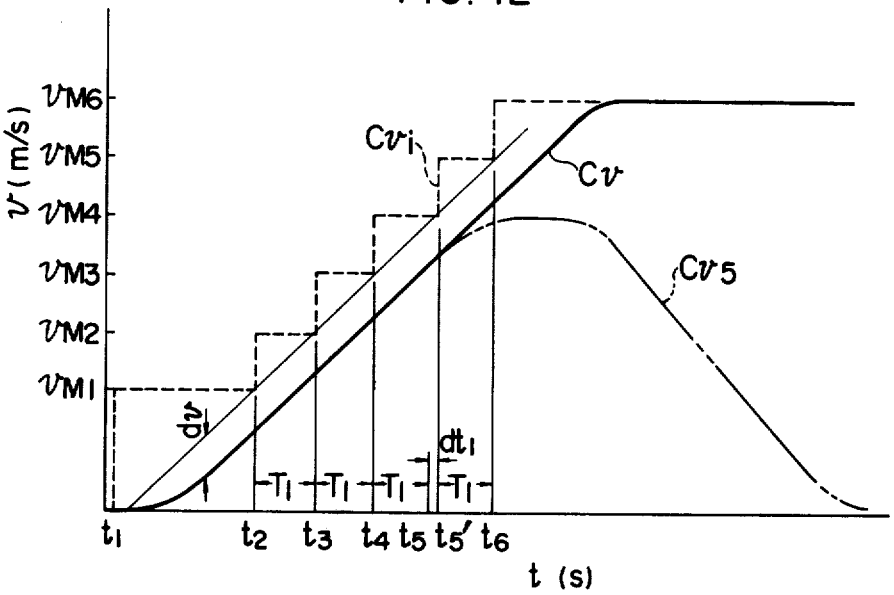
Figure 13:
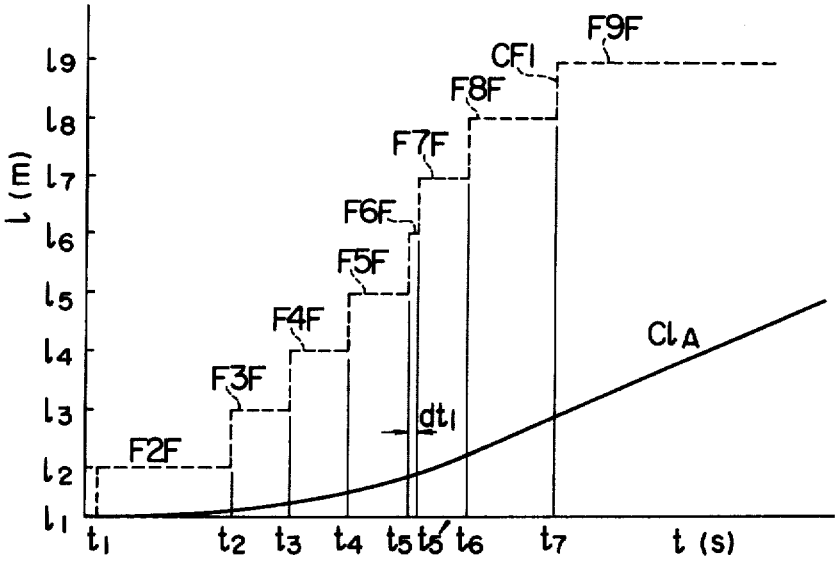
Figure 14:
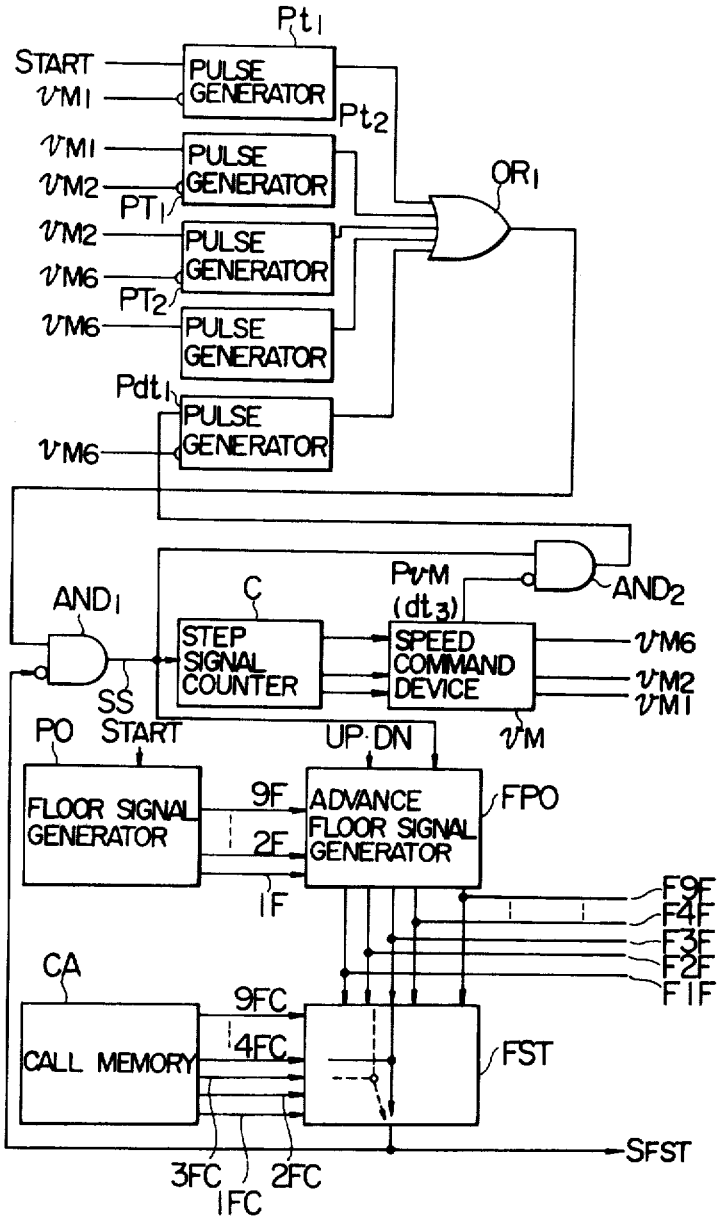
Figure 15:
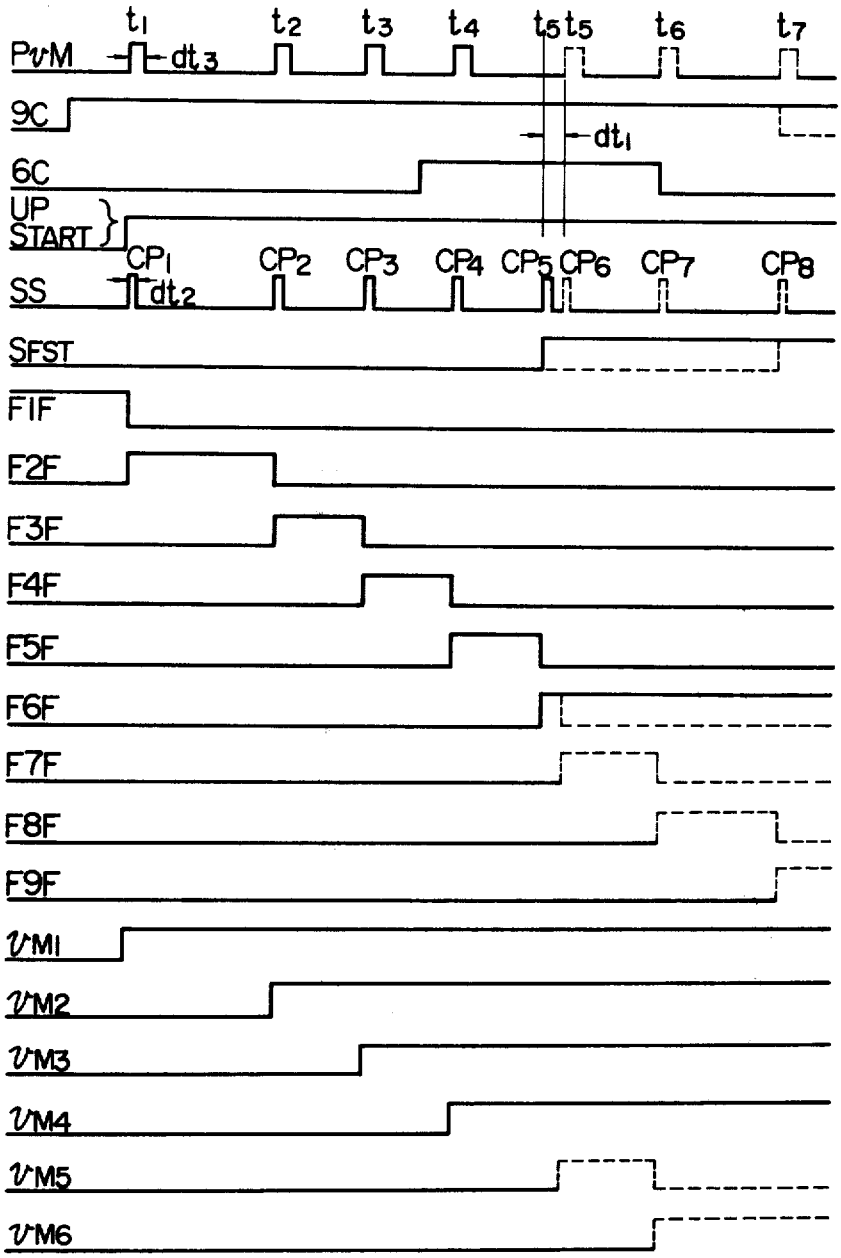

The above and other objects, features and advantages of the invention will be made apparent by the detailed description taken in conjunction with the accompanying drawings, in which:

FIG. 1*a* and FIG. 1*b* are diagrams showing operation characteristics for explaining the operation of elevator cars;

FIG. 2 is a block diagram showing an embodiment of the present invention;

FIG. 3*a* and FIG. 3*b* are diagrams showing an example of an operation command issuing device for producing various signals required by the present invention;

FIG. 4 to FIG. 9 show diagrams for explaining circuits and the operation of actual examples of the apparatus according to the present invention; including FIG. 4 being a circuit diagram showing an example of the floor signal generator device and the advance floor signal generator device;

FIG. 5 being a time chart for explaining the operation of the circuit shown in FIG. 4;

FIG. 6 being a diagram showing a circuit of an example of the service floor decision device;

FIG. 7 being a time chart for explaining the operation of the device of FIG. 6;

FIG. 8*a* being a diagram showing a circuit of an example of the step signal generator device;

FIG. 8*b* being a diagram showing a circuit of an example of the device for generating basic pulses required for the circuit of FIG. 8*a*; and FIG. 9 being a time chart for explaining the operation of the circuit of FIG. 8*a*;

FIG. 10 and FIG. 11 show a circuit of another embodiment of the invention; including FIG. 10 being circuit diagrams showing examples of the floor signal generator means and the advance signal generator means;

FIG. 11 being a circuit diagram showing the service floor decision device;

FIG. 12 to FIG. 15 are diagrams showing a circuit of and for explaining the operation of still another embodiment of the invention; including FIG. 12 being a characteristics diagram for explaining the relation between the car speed command and the running speed;

FIG. 13 being a characteristics diagram for explaining the advance floor signal;

FIG. 14 being a circuit diagram showing still another embodiment of the invention; and FIG. 15 being a time chart for explaining the operation of the circuit of FIG. 14.

Prior to presenting a detailed description of the invention, the fundamentals of the invention will be explained with reference to an example of the operating characteristics of elevator cars as shown in FIG. 1.

FIG. 1*a* shows a velocity curve Cv of an elevator car with the ordinate and abscissa representing respectively the car velocity $v(m/s)$ and the time $t(s)$ that has lapsed after the car started, symbol $V_{MX}$ showing a rated maximum velocity.

An elevator car actual position curve $Cl_1$, advance position curve $Cl_2$ which might ideally be realized in the conventional apparatus, advance position curve $Cl_3$ of the conventional mechanically constructed call selector and the advance floor curve $CF_1$ according to the apparatus of the invention are shown in FIG. 1*b* with its ordinate and abscissa representing the length of travel $l(m)$ from the start floor and the time $t(s)$ that has lapsed after the car started. The diagram of FIG. 1*b* assumes the case in which the car travels upward to the eighth floor 8H from the second floor 2H as a start floor and the length of travel from the second floor 2H to the other upper floors is $l_3$ to $l_8$ respectively.

Assume that the car is staying at the second floor when a hall call is issued from the 7th floor for up travel. A start command for up travel is issued to the car and the car is accelerated along the velocity curve Cv, illustrated in FIG. 1*a* thus travelling upward as shown by actual position curve $Cl_1$. A decision to stop next at the 7th floor at the time of start should be withheld since a call might be generated to serve, say, the 5th floor at the next instant.

The advance position curve $Cl_2$ represents the position nearest to the actual position curve $Cl_1$ where the car is capable of stopping by deceleration. Specifically, as of time point $t_4$, the length of actual travel covered by the car is $Cl_A$ and the length of advance travel $Cl_A + Cl_B$, $Cl_B$ showing the length required for the car running at the velocity of $V_{MX}$ to stop by deceleration. In this way, the nearest floors capable of being served by the car running along the actual position curve $Cl_1$ depend on the advance position curve.

What is required here, therefore, is to generate an advance position signal or advance floor signal not lagging behind the advance position curve $Cl_2$ which is advanced in the direction of car travel by the required decelerating distance from the corresponding car position shown by the actual position curve $Cl_1$, and the advance position signal or advance floor signal thus generated may be used in search of any floor issuing a call.

The conventional apparatuses generate such an advance position signal by the use of a synchronizer or advancer, as mentioned above, mounted on a mechanically constructed call selector. In other words, the synchronizer is made to run in synchronism with the actual position curve $Cl_1$, while the advancer mounted on the synchronizer and driven by a motor runs in advance of the car actual position along the advance position curve $Cl_2$. Depending on the advance position detected by the advancer and the presence or absence of a call to serve a floor corresponding to that advance position, the floor to be next served is detected. The advancer, which is driven by a motor, cannot be made to run exactly along the advance position curve. This is partly because it is necessary to provide an ample margin of operation taking into consideration torque variations due to variations in motor voltage as well as speed variations due to variations in friction of moving members, and partly because the motor must be made to run at fixed speed for accurate operation by avoiding complicated regulation. As a result, the advance position curve $C1_3$ for the conventional apparatus is for in advance of the advance position curve $C1_2$ as shown in FIG. 1b.

It will thus be noted from the drawing that the time available for the car to respond to a 3rd-floor call after its starting from the 2nd floor is so short that a passenger in the cage who took the car at the 2nd floor must push the appropriate cage-call button immediately after taking the car, if he wants to get off at the 3rd floor. Otherwise, the car is unable to serve the 3rd floor, resulting in the car riding past his destination resulting in deteriorated service. Also, in spite of the fact that a hall call for, say, the 4th floor generated before time $t_2$ after the start of the car might otherwise be able to be served, the car actually cannot serve other than a 4th-floor hall call generated before time $t_a$ at which the advancer passes the 4th floor. A hall call generated between time points $t_a$ and $t_2$ which otherwise might be served by deceleration is required to be served by another car, leading to a reduced car operating efficiency and a longer waiting time for prospective passengers waiting in the halls.

According to the call selection apparatus comprising electronic circuits, the advance position is determined on the basis of the sum of the length of car travel and the required distance for deceleration and also the fact is considered that both the length of car travel and the required deceleration distance have a certain relation to the time which has lapsed after the car started.

Further, in view of the fact that the advance position signal for detecting a calling floor to be next served need not necessarily be continuous, the apparatus according to the present invention is so simplified in construction that advance floor signals in stepped form are generated as shown in curve $CF_1$ of FIG. 1*b*.

In the advance floor signal curve $CF_1$ according to the invention, the advance floor signal F2F is shifted to the advance floor signal F3F for the 3rd floor at the same time that the car thus far staying at the 2nd floor starts upward, as shown in the drawing. Unless a cage call or hall call for the 3rd floor is generated before time $t_1$, the advance floor signal is shifted from F3F to F4F. Incidentally, the time $t_1$ is determined as desired as far as it does not lag behind the advance position curve $Cl_2$, even though an unnecessarily short time $t_1$ will result in a reduced operating efficiency, as explained already with reference to the advance position curve $Cl_3$, because of a correspondingly short time period available for the car to respond to the 3rd-floor call. In like manner, the advance floor signal is advanced in sequence toward advance floors before time points $t_2$ to $t_n$, until the floor generating a call coincides with the advance floor signal. When a floor calling the car is detected, subsequent operation for advancing the advance floor signal is stopped.

In this way, it is possible to obtain a proper advance floor signal by appropriately selecting in advance the time points $t_0$ to $t_n$ at which the advance floor signal is to be shifted.

The present invention will be described below with reference to an embodiment shown in the drawings.

In FIG. 2 showing a block diagram of an embodiment of the invention, reference symbols have meanings as defined below.

SSG: A step signal generator for generating step signals SS for sequentially advancing the advance floor signal after the issuance of a START command. This generator is preset, for example, to generate step signals at time points $t_0$ to $t_5$ shown in FIG. 1, respectively.

PO: A floor signal generator for applying to the advance floor signal generator FPO a signal indicative of the floor at which the car is staying.

FPO: An advance floor signal generator to which a floor signal representing the start floor is applied from the floor signal generator PO until immediately before starting, and which generates, after the start of the car, advance floor signals by sequentially advancing the floor signal in the direction shown by up or down travel signal UP or DN respectively in response to the signal SS generated at the step signal generator SSG, thus forming the advance floor curve $CF_1$.

CA: A call memory for storing up and down hall calls and cage calls for advance floors by floor and for producing signals 1FC to 9FC in accordance with the floors for which car service is pending.

FST: A service floor decision device to which the sequentially shifted advance floor signals are applied in search of floors from which calls are generated. If a call is generated from a floor corresponding to the advance floor signal, the device decides that the car stop at that particular floor and issues a service command signal SFST.

When a call is generated from a floor other than the floor at which the car is staying, it starts to move toward that calling floor. The operation of the circuit of FIG. 2 will be described with reference to the case in which an up hall call for the 7th floor is issued to the car staying at the 2nd floor as in the case of FIG. 1.

Before the issuance of a START command, the floor signal generator PO produces a signal 2F representing the 2nd floor at which the car is staying, while the advance floor signal generator FPO stores the floor signal 2F, that is, a start signal and produces an advance floor signal F2F indicative of the 2nd floor.

With the generation of the up hall call from the 7th floor, an up travel is detected by a conventinal operation command device, an embodiment of which is shown in FIG. 3, a door is closed to place the car in readiness, and an up travel start signal UP and a START signal are applied to the motor control device and the like, as well as to the step signal generator SSG and the synchronous floor signal generator PO shown in FIG. 2. In response to the START signal, the step signal generator SSG is energized and, simultaneously with the starting of the car, produces a first step signal whereupon the advance floor signal is shifted upward by one floor from the 2nd floor signal representing the start floor to the 3rd floor signal F3F.

The advance floor signal F3F is applied to the service floor decision device FST, which searches for any call which might be present to stop at the 3rd floor. In the event that the call signal 3FC corresponding to the advance floor signal F3F is not generated from the call memory CA until time $t_1$, the service command signal SFST is not produced but the step signal generator SSG produces a second step signal, with the result that the advance floor signal is shifted from F3F to F4F. The advance floor signal F4F thus generated from the advance floor signal generator FPO is transmitted in like manner to the service floor decision device FST.

Let us now consider a case in which a 4th floor cage call is generated before time $t_2$. This 4th-floor cage call is stored in the memory CA which is turn produces a 4th-floor call signal 4FC which is further transmitted to the service floor decision device FST. The service floor decision device FST detects that a call is generated at a floor corresponding to the advance floor signal F4F, and as a result produces and stores a service command signal SFST. This service command signal SFST is applied to the step signal generator SSG thereby to prevent subsequent generation of step signals which otherwise might be generated at time $t_2$, $t_3$ and so on. The advance floor signal is thus fixed to F4F. In the meantime, the service command signal SFST is applied to the motor control device and the like, so that in response to a logical product of it and the advance floor signal F4F, it is decided that the floor to be next served is the 4th floor, thus decelerating and stopping the car at the 4th floor.

The service command signal SFST may also be used to drive a signal device such as an arrival forecasting device for informing hall-waiting prospective passengers that the car is just arriving at the floor, as is already used in the conventional apparatus.

The embodiment of the invention described above will be explained more specifically below with reference to the case involving service floors from the 1st to 9th floors, even though it is obvious that the illustrated method may be applied with equal effect to cases involving any number of service floors.

The diagrams of FIG. 3*a* and FIG. 3*b* show an example of the operation command device generating various signals including the START signal, up travel signal UP, down travel signal DN and others as shown in FIG. 2. This device is a conventional one, an example of which is described in the present specification. Incidentally, the operation command device according to the present embodiment involving a plurality of cars employs logical circuits to which hall call allotment signals 1US to 8US and 2DS to 9DS and hall calls 1UH to 8UH and 2DH to 9DH are applied to obtain call signals 1FC to 9FC for respective floors, but such logical circuits are not required when a single elevator car is involved or hall calls are not allotted to a plurality of cars. The hall call allotment signals 1US to 8US and 2DS to a 9DS change to high level H when a hall call concerned is allotted for service. When a hall call is generated at one of the floors of a building having a plurality of elevator cars in juxtaposition, for instance, the allotment signal is issued to allot the hall call to one of the cars. The circuit of FIG. 3 will be explained below in the order of its operation.

It is assumed that, as in the preceding case, an up hall call is generated at the 7th floor while the car is staying at the 2nd floor, and that the hall call 7UH is allotted to the car, so that the resulting hall call allotment signal 7US is in the high level state H. With the generation of the 7th-floor up hall call 7UH and the hall call allotment signal 7US, the 7th-floor call signal 7FC is generated and changes to signal level H through an AND gate 273 and an OR gate 272 as shown in FIG. 3*b*. This call signal 7FC is applied to the OR gate 275 and the OR gate 276. Since the car is staying at the 2nd floor, on the other hand, only the 2nd floor signal 2F is in high level state H, while the other floor signals 1F, 3F to 9F are in the low level state L. As a result, the AND gate 278 for the 7th floor produces an output in response to the signals from the OR gate 275 and an inverter 271. The output signal from the AND gate 278 is applied through the 6th-floor OR gate, an AND gate (constructed in like manner but not shown in the drawings) and through OR gate 235, AND gate 238, OR gate 225 and through AND gate 228. Since the 2nd-floor signal 2F is at level H and the output of the inverter 221 at level L, no output is produced from the AND gate 227 or AND gate 228, thus preventing a signal from being applied to the stages subsequent to the AND gate 228.

The output of the OR gate 276, on the other hand, is applied through OR gate 276, AND gate 227, an OR gate and an AND gate for the 8th floor (similarly constructed but not shown), OR gate 296 and AND gate 297, thereby producing an up travel call signal UPC, whereby the car is placed in readiness for up travel preparing the motor for being driven and closing and locking the door.

After ascertaining the safety for up travel in response to the up travel call signal UPC, the signal SAFS in FIG. 3*a* becomes H. Also, when the door is locked after being closed, the signal DL changes to level H. The AND gate 315 produces an output, so that the signal SPAS indicating the readiness of the car start changes to level H. When the electromagnetic brake of the motor is released to enable the car to start, the signal BROP changes to level H, so that a START signal is produced through the AND gate 316. At the same time, the AND gate 313 produces an output signal and the up travel signal UP changes to H, since the up travel call signal UPC and hence the output signal from the AND gate 311 at level H. In this manner, when a 7th-floor up hall call 7UH is generated while the car is staying at the 2nd floor, the upward travel required is ascertained by the signal UPC, followed by the generation of a ready-to-start signal SPAS, a start signal START and an up travel signal UP.

Assume, by contrast, that a 3rd-floor down hall call is generated and a hall call allotment signal 3DS is produced while the car is staying at the 5th floor. As will be apparent from the description of the preceding case, the down travel call signal DNC and the down travel signal DN are generated but neither the signal UPC nor signal UP is produced.

Reference is had to the diagram of FIG. 4 showing actual examples of the floor signal generator PO and the advance floor signal generator FPO illustrated by the blocks in FIG. 2, and also to the time chart of FIG. 5 for explaining the operation of the circuit of FIG. 4.

In FIG. 4, the floor signal generator PO comprises a movable contact piece S and a plurality of fixed pieces 1FS to 9FS, while the advance floor signal generator FPO comprises the remaining elements in the drawing.

The movable contact piece S is mounted on the car, whereas the fixed contact pieces 1FS to 9FS are arranged at points corresponding to the respective floors within the hoistway, so that the movable contact piece is brought into contact with the fixed contact pieces 1FS to 9FS according to the car position.

In the case where the car starts at the 2nd floor, for instance, the fixed contact piece 2FS is in contact with the movable contact piece S prior to start of the car and the start signal START is in the low level state L. So, the signal L is applied to the fixed contact piece 2FS and to the preset terminal PS of the flip-flop 25. The positive output terminal Q of the flip-flop 25 is preset at signal level H, thereby producing an advance floor signal F2F. The positive output terminals Q of the flip-flops other than the flip-flop 25 are cleared to level L since the ready-to-start signal SPAS from the circuit of FIG. 3 is at level L and is applied to the clear terminals CL of the respective flip-flops as long as the car is placed in readiness to start. As a result, only the advance floor signal F2F for the same floor as the starting floor signal 2F is stored in memory prior to starting of the car.

Under this condition, if an up travel call is detected and the car is placed ready to start, the signal SPAS changes from level L to level H and the cleared state of the clear terminals is terminated, thereby enabling all the flip-flops 15 to 95 to be available for the shifting operation.

Upon receipt of the up travel signal UP and the start signal START from the circuit of FIG. 3 after the car is ready to start, the signal START for the movable piece S beocmes level H and the flip-flop 25 is released from the preset state.

Also, the up travel signal UP permits the AND gates 21, 31, 41, . . . 91 to pass the advance floor signals F1F to F8F, so that a shift circuit for up travel is made up of the flip-flops 15, 25, 35, 45, . . . 95.

The first pulse from the step signal generator SSG is applied to the clock terminals CP of the flip-flops 15 to 95 for all the floors, whereupon information is called in from the input terminals J and K and introduced to the output terminals Q for storage. Immediately prior to the generation of the first pulse, the advance floor signal F2F for the same floor as the 2nd floor is applied to the J-K input terminals of the flip-flop 35 through the AND gate 31 and the OR gate 33, but not to the J-K input terminals of the remaining flip-flops. Thus the advance floor signal shifts from F2F to F3F in response to the first pulse. Further, at time points $t_1$ and $t_2$, the second and third pulses cause the advance floor signal to shift to F4F and to F5F in sequence, in like manner, for up travel, as shown in the time chart of FIG. 5.

When the car is running downward, on the other hand, the down travel signal DN is generated and the flip-flops for the respective floors complete a circuit for downward shifting through the AND gates 12, 22, 42, . . . 82, in such a manner as to effect downward shifts in response to the step signal SS.

Next, an actual example of the service floor decision device FST will be explained with reference to FIG. 6 and FIG. 7.

The AND gate 16 is for detecting the coincidence between the advance floor signal F1F and the cage call 1C. In like manner, the AND gates 26 and 96 are provided for the purpose of detecting cage calls for the respective floors from 2nd and 9th. The OR gate 1 produces a signal ΣCA when a cage call coincides with an advance floor signal. Similarly, the AND gates 17 to 87 detect the coincidence between the advance floor signals F1F to F8F and the up hall calls 1UH to 8UH, respectively. As a result, the OR gate 2 produces a signal or level H when there is a coincidence between an up hall call and an advance floor signal. The output of the OR gate 2 is applied to the AND gate 3, so that the signal ΣUP·H is converted into the level H when the up travel signal UP at level H. This is due to the fact that there are two types of hall calls, up and down, and therefore search for a call must take into consideration the direction of car travel. A similar circuit is also required for seaching for a hall call for down travel, but will not be described here for simplicity of explanation other than to say that there is a signal ΣDN H for downward travel coinciding with a down hall call.

The output from the OR gate 4 makes up a final coincidence signal for a call. When the output of the OR gate 4 becomes level H after the starting of the car, it is stored in the NOR gates 5 and 6 since the START signal at level H.

A time chart for call search made in the circuit of FIG. 6 is shown in FIG. 7, and it shows the case in which the car starts for service in response to the 4th floor cage call 4C. Prior to the START signal reaching level H, all the signals including the 4th-floor cage call 4C, the ready-to-start signal SPAS and the advance floor signal F2F are at level H. As mentioned already, immediately after the car has started, the first upward shift is made thereby to convert the advance floor signal F3F to level H. Unless there is no 3rd-floor hall call 3UH of 3rd-floor cage call 3C generated before the second shift, the advance floor signal changes from F3F to F4F, and F4F becomes level H. Since the 4th-floor cage call 4C is present, the AND gate 46 detects the coincidence immediately following the completion of the second shift, so that the coincidence signal is applied to the OR gates 1 and 4 and stored in the NOR gates 5 and 6, converting the service command signal SFST to level H.

It will thus be understood that a cage call or hall call for a floor corresponding to an advance floor signal is searched for, and in the presence of a call for a floor corresponding to the advance floor signal, the service command signal SFST is converted to the level H.

The step signal generator SSG will be now explained. This step signal generator SSG is provided for timed sequential advancing of the advance floor signal as shown in FIG. 1 or FIG. 5. As already explained in FIG. 1b, the advance floor signal must be in advance of the floors represented by the advance position curve $C1_2$. Therefore, it is necessary to generate a step signal in such a timing as to advance the advance floor signal to the next floor not later than the time when the advance position of the car passes each advance floor after the car has started.

Since the car is accelerated after starting, the time intervals between respective floors are progressively shortened until it reaches rated speed. As a result, the intervals of step signals must also be adjusted as shown by time points $t_0$ to $t_5$ in FIG. 1b. It should be noted here that the time points $t_0$ to $t_5$ have a certain relation with the time which has lapsed after the car has started.

It was already mentioned that the timing of step signal generation is easily determined in accordance with the time that has lapsed after the starting of the car.

Detailed description will be made below with reference to actual examples in which a single pulse is generated as a step signal for each predetermined time interval.

Figure 8C:
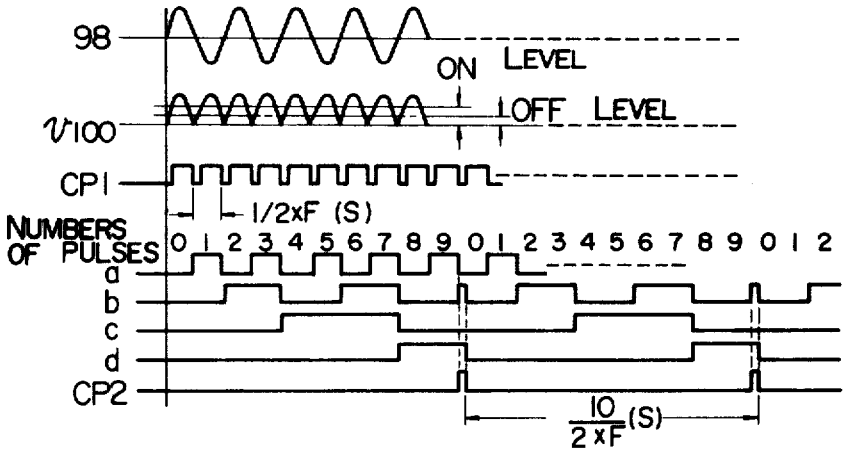

The circuit diagram of FIG. 8a shows a case employing binary counters; the diagram of FIG. 8b shows a device for generating a signal used in the circuit of FIG. 8*a;* the diagram of FIG. 8c shows a time chart for explaining the operation of the circuit of FIG. 8*b;* and the diagram of FIG. 9 shows a time chart for explaining the operation of the step signal generator according to the embodiment under consideration.

After detecting that the START signal has changed from level L to level H, the step signal SS for the starting time $t_0$ is produced from the NOR gate 136 in response to a single pulse generated from a monostable multivibrator comprising an AND gate 130, a lead-equipped gate 127 and a capacitor 128. The step signal $\overline{SS}$ which is the output from the NOT gate 137 is applied to the clock input terminal CP of a 5-bit shift register 125, thereby converting the output Q1.

The timing in which the step signal for time $t_1$ is generated will be explained. First, basic pulses $CP_2$ with a predetermined frequency as shown in FIG. 9 are generated by the use of an oscillation circuit including a crystal oscillator or a commercial AC power supply. An embodiment of such an oscillator is shown in FIG. 8*b*.

In the drawing, the signal produced from the commercial power supply 98 with the frequency F(HZ) is full-wave rectified by a full-wave rectifier 100 through a transformer 99. The resulting rectified signal is applied to a voltage divider comprising a Schmitt gate 101, a resistor 102 and a resistor 103, whereby a clock signal $CP_1$ of F(HZ) × 2 is obtained. This clock signal $CP_1$ is frequency-divided by a frequency-divider circuit comprising a 4-bit binary counter 104, a dual package type switch 107, and AND gate 105, an AND gate 106 and a NOR gate 108, which can be set as desired, thus producing the basic pulses $CP_2$.

The operation of the circuit of FIG. 8b will be explained with reference to the case using the frequency-divider circuit for 1/10 reduction. The time chart associated with the operation is shown in FIG. 8c. When the counts of the binary counter 104 changes from 9 to 10, the AND gate 105 detects the level H of the binary signals *b* and *d* connected to the dual package type switch 107, thus producing the basic pulse $CP_2$. The binary counter 104 counts one bit when the clock pulses $CP_1$ changes from level H to level L. When the counts change from 9 to 10 as above, the NAND gate 106 detects that the basic pulses $CP_2$ and the clock pulses $CP_1$ have assumed the level H, so that the output of the NAND gate 106 is applied to the clear terminals $CR_1$ and $CR_2$ of the binary counter 104 through the NOR gate 108. As a result, the counts of the binary counter 104 are cleared to prepare itself for the next counting operation. By the way, the transformer 99 is provided for insulating the AC power supply 98 from integrated circuitry. Also, the START signal applied to the NOR gate 108 is for achieving a synchronism of pulses at time $t_0$ with the basic pulses $CP_2$.

The basic pulses $\overline{CP}_2$ thus obtained are applied to a plurality of stages of binary counters 121 and 122. The variations of the output signals A to E resulting from the counting operation of the binary counters 121 and 122 are as shown in FIG. 9.

Assume that the time period $T_{01}$ from time $t_0$ to $t_1$ corresponds to 19 basic pulses $\overline{CP}_2$ and that the time $T_{12}$ corresponds to 9 basic pulses. The binary counters 121 and 122 begin to count the basic pulses $\overline{CP}_2$ at time $t_0$ when a step signal is generated. When the number of counts reaches 19 at time $t_1$ after the lapse of time period $T_{01}$, signals A, B and E out of the signals A to E representing the first to fifth order of digits respectively are turned to level H, which is detected by the NAND gate 131 impressed with the signal $St_0$, so that the output of the NAND gate 131 is applied through the NOR gate 136 thereby to produce a step signal SS at time $t_1$.

Upon generation of the step signal SS at time $t_1$, the binary counters 121 and 122 are cleared by the same signal and resumes the counting of the basic pulses $\overline{CP}_2$ from zero. At the same time, the step signal $\overline{SS}$ is applied to the clock terminal CP of the shift register 125, the output of which transfers from terminal Q1 to Q2, with the result that the signal $t_1$ becomes level H. The number 9 of the counts corresponding to the time length $T_{12}$ until time $t_2$ represents the state in which signals D and A are at level H. This state is detected by the NAND gate 132 to which the signal $St_1$ is applied, thus producing a step signal SS at time $t_2$. In like manner, step signals SS are produced from the NOR gate 136 at times $t_3$ to $t_5$ when the counts corresponding to the times $T_{23}$ to $T_{45}$ are detected by the NAND gates 133 to 135, respectively.

In the above-described embodiment, a plurality of binary counters are used to generate step signals having time intervals in accordance with the time that has lapsed after start of the car. Therefore, by selecting the inputs to the NAND gates 131 to 135 which are supplied from the binary counters 121 and 122 and shift register 125, appropriate step signals can be generated at time points corresponding to the times $t_1$ to $t_5$ in FIG. 1*b*. It is thus possible to obtain an almost ideal pattern of the advance floor signal curve $CF_1$ approximating the curve $Cl_2$ shown in FIG. 1*b*.

Another method using a simplified step signal generator may be to generate step signals at regular time intervals after the starting of the car. The length of such regular intervals may be determined on the basis of the average of the time lengths $T_{01}$ to $T_{32}$ of FIG. 9 or on the basis of the length from time $t_2$ to $t_3$ or time $t_3$ to time $t_4$. For example, without using the shift register 125 of FIG. 8a, the above-mentioned method is easily achieved by detecting the output state of the binary counters 121 and 122 with a signal NAND gate 131. In spite of the simplicity of construction according to this method, however, the advance floor signal is somewhat in advance of the advance position, resulting in a reduced operating efficiency for the reasons already mentioned.

Still another possibility is to divide the intervals of step signal generation into two types for the car accelerating and running at rated speed, so that the intervals equivalent to the average of the times $T_{01}$ to $T_{34}$ are provided during the acceleration while the time $T_{45}$ is determined as the interval during the running at rated speed. In this case, too, this may be done, without the shift register 125, by using the binary counters 121 and 122 and the NAND gates 131 and 132. Also, the input signals $St_0$ and $St_1$ of the NAND gates 131 and 132 are replaced by a signal indicating the accelerated state and a signal indicating the running at rated speed, respectively.

In this way, there are various methods for generation of step signals, any of which may be used to suit respective cases.

In some buildings, intervals between floors have different length. The first and second floors, for instance, may have different celling height than the other upper floors. In such a case, the time required for the car to pass a given floor is different from that required to pass another floor, resulting in different timing required for generating a step signal for different floors. Ideally, therefore, advance floor signals should preferably be obtained by determining different intervals of generation of step signals for different starting floors. This, however, requires a step signal generator which is both quite complicated and high in cost, and it is recommended that one of the above-described methods should appropriately be used on the basis of the shortest floor-to-floor length.

As will be seen from the foregoing description, the present invention, which has a very effective electric circuit as the call selection apparatus for deciding a floor to be next served by the car, has the following advantages:

1. The fact that all component elements are constructed of electric circuits makes possible the provision of selection apparatus which is very compact as with the conventional apparatuses without regard to the number of floors involved. Skyscrapers, for example, in which it is very difficult to use the conventional apparatuses because of their bulkiness, can easily accomodate the apparatus according to the invention.

2. Since an advance floor signal is generated without using any mechanical means, the selection apparatus is highly reliable and subjected to no wear.
3. The fact that the motor for driving the advancer, the motor circuit and the complicated mechanical parts for the advancer requiring high precision and resistivity to wear are all replaced by small low-cost semiconductors including integrated circuits makes it possible to embody the invention at a cost about one half that of the conventional apparatuses.
4. The length of the lead of the advance floor signal can be adjusted as desired by controlling the timing of the step signal, for example, by regulating the period of the basic pulses or the number of counts to be made.
5. The advance floor signal need not take into consideration any margin which was required in the conventional apparatus due to the wear of the mechanical components or the advancer drive motor, but the only requirement is to maintain a required minimum deceleration length from the car position. As a result, there is available a longer period of time before which the car may be able to respond to a call, resulting in an improved car operating efficiency.

The present invention is not of course limited to the embodiments described above. Instead, the floor signal generator PO may comprise contactless proximity switches or microswitches disposed in the elevator hoistway. Also, as the advance floor signal generator FPO, a 4-bit right-shift left-shift register or 5-bit shift register may be used. In other words, the apparatus according to the invention is comprised of the devices illustrated by the use of blocks in FIG. 2, and the devices usable in respective blocks are not limited to those already illustrated with reference to embodiments described above.

Other embodiments of the invention will be explained with reference to FIG. 10 and FIG. 11 which utilize binary digits into which the floor signals are coded.

The embodiment shown in FIG. 10 uses coded binary numbers and corresponds to the floor signal generator PO and the advance floor signal generator FPO shown in FIG. 4.

The embodiment of FIG. 11, on the other hand, uses coded binary numbers and corresponds to part of the advance floor signal generator FPO and the service floor decision device FST.

In FIGS. 10 and 11, like reference symbols denote like component elements in FIGS. 4 and 6, the other symbols having the meanings as defined below.

DUDC: A 4-bit decode up-down counter making up an advance floor signal generator FPO operating in response to various inputs. This is preset in accordance with data input signals DAT·A to DAT·D. The output of this device changes to UP when the count input signal COUNT·UP transfers from level L to level H. In the event that the outputs QD to QA are preset at 0010 (2 in decimal number), for instance, counts change to 0011 (3 in decimal number).

NDA to NDD: NAND gates constituting a coder circuit for encoding the start floor into a binary number; for example, the 1st floor into 0001, the 2nd floor into 0010, the 3rd floor into 0011 and the 4th floor into 0100. Each of these devices comprises a negative logical circuit.

7, 8: AND gates

DCD: A decoder for converting the binary numbers applied to the input terminals IA to ID into decimal numbers which are produced at the output terminals Y1 to Y9 as negative signals.

DTC: A data selector which produces at the output terminal $\overline{Q}$ only these data out of 1C to 9C applied to the input terminals D1 to D9 which are selected by the address data inputs applied to the address data input terminals AD to AA. When the address data applied is 0011 (3 in decimal number), for instance, the input data D3 is produced at terminal $\overline{Q}$ as a negative signal.

I1 to I9: Inverters

9, 10: NAND gates each making up a memory.

It was already explained that the car starting at a given floor starts to move toward a floor for which a call is generated. Description will be made here with reference to a case in which the car is standing at the 2nd floor and a cage call for the 4th floor 4C has been generated. Until the start command signal START is issued, the movable contact piece S is contact with the fixed contact piece 2FS, and the synchronous floor signal is coded into 0010 by the NAND gates NDA to NDD. Further, the decode up-down counter DUDC, the load input terminal LOAD of which is at the low level L, has the output terminals QD to QA preset at 0010.

When the car starts to move upward, the step signal SS produced at the already-described step signal generator SSG is applied through the AND gate 6 to the count input terminal COUNT-UP of the decode up-down counter DUDC.

In response to the first rise of the first step signal at time $t_0$, the decode up-down counter DUDC counts up from 0010 representing the starting 2nd floor to 0011 representing the 3rd floor. In the same way as shown in FIG. 9, the advance floor signal changes sequentially in binary form and is produced at the output terminals QD to QA.

If the advance floor signal in decimal form is required, the decoder DCD as shown in FIG. 11 may be provided, whereby it is possible to obtain the advance floor signals F1F to F9F in decimal form from the binary-coded advance floor signals D to A produced by the decode up-down counter DUDC.

The advance floor signal 0011 corresponding to the 3rd floor of the decode up-down counter DUDC is applied to the address input terminals AD to AA of the data selector DTC. Until time point $t_1$, the address input remains 0011 and the call signal 3C applied to the data input terminal D3 is produced at the output terminal $\overline{Q}$ as a negative signal. In the L state in the absence of a 3rd-floor cage call 3C, the output of the data selector DTC is at the level H, so that no service command signal SFST is produced.

At time $t_1$, the rise of the second step signal causes the outputs QD to QA of the decode up-down counter DUDC to count up from 0011 to 0100, which is applied to the data selector DTC as an address input. The cage call signal 4C applied to the input D4 is selected and produced at the output terminal $\overline{Q}$. The level H of the 4th-floor cage call 4C causes the output $\overline{Q}$ to be at the level L, with the result that the memory circuit comprising the NAND gates 5 and 6 generate and store the service command signal SFST.

Instead of searching only for cage calls by applying the cage calls 1C to 9C as data inputs to the data selector DTC, it will be obvious that hall calls may be served in similar manner by using selectors for different directions of car travel.

A brief explanation was made above of the case in which the present invention is implemented by coding the floor signals into binary numbers.

In addition to the advantages mentioned above, the present embodiment makes possible a simple and compact apparatus. In view of the recent trend toward higher building involving a multiplicity of cars running at higher speed under a group control system relating the cars to each other, the elevator control system is more and more complicated, and a data processing system has come to be considered to be a solution to this problem. For this purpose, the embodiment under consideration which utilizes binary numbers for signal processing may be easily incorporated in the data processing system used with the elevator control apparatus, thus eliminating any need to provide another special device as the call selector.

A further embodiment of the invention will be explained below.

The conventional elevator speed regulation device is such that, for the purposes of simplicity, the number of floors to be passed by the car after its starting until the proposed arrival at the next floor to be served is detected and the maximum speed of the car is accordingly determined on the basis of that number of floors. The embodiment under consideration can be effectively applied to such a conventional control device.

During the acceleration of the car, maximum speed commands for progressively higher speeds must be issued at regular time intervals as shown in FIG. 12. In this way, the acceleration command of the car is made larger than the actual car speed by $dv$ or more, thus making it possible to accelerate the car smoothly at a fixed accelerating rate. The embodiment under consideration is characterized in the step signal for advancing the advance floor signal is generated by the use of the maximum speed command signal, taking into account the fact that the time intervals at which the maximum speed command signals are generated are fixed.

The fundamentals of the embodiment will be described with reference to FIG. 12 and FIG. 13.

The ordinates of FIG. 12 and FIG. 13 represent the car velocity $v$ in m/s and the length of travel $l$ from the starting floor in meters m respectively, the abscissae for both drawings representing the length of time period $t(s)$ that has lapsed after the car has started at the starting floor. The symbol Cv shows the car velocity curve. Generally, the acceleration of the car is controlled depending on the relation between the riding comfort and operating efficiency. In other words, the velocity curve Cv takes a rectilinear form except for the beginning and end of the acceleration. In order to obtain such a rectilinear velocity curve, it is necessary to apply to the input of the velocity control device a velocity command which is always higher than the then car speed by $dv$. In a high-speed elevator, on the other hand, a command of the maximum speed vM1 commensurate with the length of travel instead of the rate maximum speed vM6 must be issued when the car is running from 1st to 2nd floor to serve the latter. An elevator control device having six maximum speeds vM1 to vM6 will be explained below.

Assuming that the velocity difference between respective maximum speeds is fixed, the maximum speed commands vM2 to vM6 are required to be issued at the latest before time points $t_2$ to $t_6$ respectively with car acceleration, the time interval between adjacent time points being $T_1$ for all of time points $t_2$ to $t_6$.

The timing at which the maximum speed commands are issued is not limited to the time points $t_1$ to $t_6$ shown in FIG. 12, but may be shortened as far as the riding comfort permits. Excessively shortened intervals, however, result in reduction in time available for the car to respond to a call generated after starting, leading to deteriorated overall service of the elevator system, as already explained.

The graph of FIG. 13 illustrates the case in which the car has started at the lst floor toward the 9th floor. Unless a call is generated until time $t_2$ for service of the 2nd floor, the maximum speed command is switched to vM2 and the control device begins to search for a call for the 3rd floor. In like manner, in the absence of a 3rd-floor call generated prior to time point $t_3$, the maximum speed command is changed to vM3 while at the same time beginning to search for a 4th-floor call. Similar processes of operation are repeated at time intervals $T_1$ until a call is detected. In such an operating system, each timing of switching of the maximum speed command corresponds to that of switching of the advance floor signal, so that the advance floor signal may be switched in synchronism with the maximum speed command signals.

The elevator cars in a high-speed elevator system, however, are operated on the same maximum speed command for a plurality of floors. In the embodiment under consideration, for example, the car runs on the same maximum speed command vM4 for both the 5th and 6th floors. In other words, if the car speed is accelerated from time $t_4$ to time $t_5$ and a new maximum speed command vM5 is issued at time $t_5$, the car is unable to decelerate to serve the 6th floor. It is therefore necessary to detect calls for the 5th and 6th floors, if any, until time $t_5$, in which case the timing of switching of the maximum speed commands does not necessarily correspond to that of switching of respective advance floor signals, even though the advance floor signal can be generated for call detection in the manner mentioned in the following: Search is made for a 5th-floor call until time $t_5$, that is, $t_4$ plus $T_1$ and the absence of a new maximum speed command is detected at time $t_5$, so that search for a 6th-floor call is made during the time $dt_1$ which is negligibly short compare with the time $T_1$. At time $t'_5$ ending the time period $dt_1$, a transfer is made to search for a 7th-floor call, while at the same time issuing the maximum speed command $v$M5. After issuance of the rated maximum speed command $v$M6, an ample length for deceleration to the advance floor can be secured by transferring the search for a call at time intervals of $T_2$ as shown in equation (1) below.

$$T_2 = (l_9 - l_8)/vM6 \quad (1)$$

An actual example of the control apparatus according to the invention operating in relation to the maximum speed commands is shown in FIG. 14, in which reference symbols other than appearing in FIG. 2 have meanings as defined below.

C: A step signal counter circuit for counting the number of floors the car passes unitl it stops next.

vM: A speed command device fo issuing commands of progressively higher speeds than the counts made by the step signal counter circuit C. Upon issuance of a new maximum speed command, a pulse with time width of PvM is produced.

$Pt_1$: A pulse generator with a prohibition gate for producing a pulse having the width of $dt_2$ immediately after generation of the start command START, thus causing the step signal SS to be produced at time $t_1$ shown in FIG. 13 through the OR gate OR1 and AND gate AND1.

$Pt_2$: Another pulse generator with a prohibition gate for producing pulses having the width of $dt_2$ at time $t_2$ after the lapse of time $t_2$ following the distance of issuance of the first maximum speed command vM1. Pulses are not generated at other than time $t_2$ since this circuit does not operate after the maximum speed command *v*M2 is issued.

$PT_1$: Still another pulse generator with a prohibition gate for producing pulses with the width of $dt_2$ at time points $t_3$, $t_4$, $t_5$ and $t_6$. This circuit produces a pulse at regular intervals of $T_1$ after issuance of the second maximum speed command vM2, until the rated maximum speed command vM6 is issued.

$PT_2$: Still another pulse generator for producing a pulse $dt_2$ wide at regular intervals of $T_2$ upon issuance of the rate maximum speed command *v*M6. The pulses thus produced are those corresponding to the time points $t_7$ and $t_8$.

$Pdt_1$: A further pulse generator with a prohibition gate for producing a pulse with the width of $dt_2$ at time point $t'_5$. Since the pulse PvM is not produced in response to the pulse generated from the AND gate AND1 in the absence of a new maximum speed command, this circuit produces a pulse after a short time $dt_1$ following the application thereto of a pulse from the AND gate AND2. In the event that a new maximum speed command is not issued unless the advance floor is advanced by three floors, therefore, this circuit produces a couple of pulses successively at time intervals of $dt_1$.

The step signal SS is an output from the AND gate AND1 and applied to the advance floor signal generator FPO as mentioned earlier. The step signal SS is produced in the form of pulse signals at time points $t_1$ to $t_8$ in FIG. 13 in response to the output of the pulse generator $Pt_1$, $Pt_2$, $PT_1$, $PT_2$ or $Pdt_1$ until a call is detected after the car starts. In this connection, it is assumed that time $dt_3$ satisfies the relation $dt_2 < dt_3 < T_1$ and that the time $dt_1$ is not less than the time required for detection of a call.

As mentioned above, the car staying at a given floor starts to move when a call is generated at other than the particular floor and the car gate ready to start. Reference is made to the case in which, as in FIG. 13, the car staying at the 1st floor has started to travel upward in response to a call for the 9th floor. Prior to generation of the signal START, the floor signal generator PO produces the first floor signal 1F at which the car is standing, so that the information 1F is stored in the advance floor signal generator FPO. The 9th-floor call 9FC is detected by the device of FIG. 3 which produces an up travel signal UP. When the car is placed into readiness to start after the door is closed, both the start signal START and the up travel signal UP are produced. Upon issuance of the up travel signal UP, the advance floor signal generator FPO is actuated upward.

In the circuit of FIG. 14, the start signal START causes the pulse CP1 to be generated at time $t_1$ from the pulse generator $Pt_1$ and applied through the OR gate OR1 and AND gate AND1. The output of the AND gate AND1 takes the form of step signal SS and is applied to the advance floor signal generator FPO, with the result that the advance floor signal shifts from F1F representing the starting floor to F2F representing the floor higher than the starting floor by one. The step signal SS is also applied to the counter circuit C whereby a count is made to indicate a one-floor run, and the resulting signal is applied to the speed command circuit *v*M wherefrom the maximum speed command *v*M1 is issued. Subsequently, the advance floor shift to signals F3F, F4F and F5F sequentially in response to the pulses CP2, CP3 and CP4 respectively, in accordance with the time chart of FIG. 15. These pulses are counted by the counter circuit C thereby to produce the maximum speed commands *v*M2, *v*M3 and *v*M4 in that order. Even if the step signal SS is generated and the pulse signals CP1 to CP4 are applied to the AND gate AND2, the fact that the maximum speed command is issued on the respective occasions causes the pulse PvM to be generated, thus preventing the output from being produced at the output terminal of the AND gate AND2. As a result, the pulse generator circuit $Pdt_1$ is not energized.

The time chart for explaining the operation of the circuit of FIG. 14 is illustrated in FIG. 15. In the figure, the solid lines show the cases in which a 6th-floor call 6FC is generated and the dotted lines the cases in which no call is generated other than the 9th-floor call 9FC, until time $t'_5$ after the car has started in response to the 9th-floor call 9FC.

First, explanation will be made of the operation of the circuit of FIG. 14 after time point $t_4$ in association with the case where the 6th-floor call 6FC is generated not later than time point $t'_5$ after the car has started to move in response to the 9th-floor call.

After counting time $T_1$ following the generation of pulse $CP_4$ by the pulse generator $PT_1$, the pulse $CP_5$ is produced and applied in the form of step signal SS to the advance floor signal generator FPO. The advance floor signal switches from F5F to F6F. The service floor decision device FST detects the presence of the 6th-floor call 6FC and produces a service command signal FSTS. The service command signal FSTS prohibits the AND gate AND1 from producing an output, and therefore the pulse CP6, CP7 or CP8 which otherwise might be produced subsequently as step pulses SS are not generated, thus fixing the advance floor signal at F6F. In response to the pulse CP5, the counter circuit C counts five pulses after the starting of the car and produces an output indicative of passage of five floors. Incidentally, in view of the fact that the car is operated on the same maximum speed command *v*M4 both at the 5th and 6th floors, no new maximum speed command is issued at the time of generation of the pulse CP5, so that the car is operated at the maximum speed of *v*M4 as shown by velocity curve C*v*5 of FIG. 12.

Apart from the case in which the 6th-floor call 6FC is generated, the operation of the embodiment in the absence of the 6th-floor call will be explained below.

As mentioned already, the pulse C5 is generated so as to advance the advance floor signal to F6F. The counter circuit C counts the pulse CP5 for the total of five pulses from the starting of the car, and applies a signal to the speed command device, indicating a five-floor run. It was also mentioned that the embodiment under consideration is such that the car is operated on the same maximum speed command *v*M4 for coverage of both 5 and 6 floors, and therefore the new maximum speed command *v*M5 is not produced. In the resultant absence of signal P*v*M, therefore, the pulse CP5 is applied through the AND gate AND2 to the pulse generator P$dt_1$, thus producing the pulse CP6 at the output terminal thereof at time $dt_1$. The pulse CP6 is produced in the form of step signal SS through the AND gate AND1, so that the advance floor signal is advanced from F6F to F7F. At the same time, the counter circuit C counts 6 pulses, thus informing the speed command device *v*M of a six-floor run. The result is the production of the maximum speed command *v*M5 by the speed command device *v*M. Similar processes of operation are followed subsequently as shown in FIG. 15. With the generation of the advance floor signal F9F, the 9th-floor call 9FC is detected thereby to control the car to serve the 9th floor.

It will be thus understood that the embodiment mentioned above is capable of being used integrally with the conventional speed command device, enabling the conventional control apparatus to operate without significant modifications. Further, the step signal generator may be constructed in a comparatively simple and effective way.

Furthermore, the time intervals of pulses generated by the pulse generators P$t_2$ and PT$_2$ in the above-described embodiments may be provided not by a timing device but by the use of signals produced from the car position detectors disposed in the hoistway.

It will be thus seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

What is claimed is:

1. An elevator car call selection apparatus comprising means for generating step signals at a plurality of predetermined time points, means for initiating operation of said step signal generating means after said car starts from a given floor, means for generating a floor signal representing a car starting floor from which said car starts, means responsive to said step signals for sequentially generating advance floor signals of successive floors representative of the advance position at which the travelling car can be stopped by deceleration; memory means for storing at least a hall call and cage call; and means responsive to a call stored in said memory means for a floor corresponding to the floor designated by the presently generated advance floor signal for designating that floor to be served by said car, whereby said car covers a plurality of floors to answer at least a hall call and a cage call.

2. An elevator car call selection apparatus according to claim 1, in which said step signal generator means includes means for predetermining said time points in such a manner as to produce said step signals at the time when said advance position passes each of said floors after the starting of said car.

3. An elevator car call selection apparatus according to claim 1, in which said step signal generator means includes means for predetermining said time points in such a manner as to produce said step signals at regular intervals of time after the starting of said car.

4. An elevator car call selection apparatus according to claim 1, in which said step signal generator means includes means for predetermining said time points in such a manner as to produce said step signals during the acceleration of said car after the starting of said car and means for predetermining said time points in such a manner as to produce said step signals during the running of said car at rated velocity.

5. An elevator car call selection apparatus according to claim 1, in which said floor signal generator means includes means for producing said floor signal representing said starting floor in the form of a binary number, and said advance floor signal generator means increments said starting floor signal in binary number in response to each of said step signals and produces a floor signal in binary number representing the advance floors progressively advanced in the direction of car travel.

6. An elevator car call selection apparatus according to claim 1, further comprising means for deenergizing said advance floor signal generator means in response to a service command signal generated from said car service decision means.

7. An elevator car call selection apparatus according to claim 1, further comprising means for producing a signal specifying a maximum car speed in accordance with the distance to be covered by said car without intermediate service, said step signal generator means producing a step signal after a predetermined period of time both following the generation of a start command signal and following the generation of a new maximum speed command signal.

8. An elevator car call selection apparatus according to claim 7, in which said step signal generator means includes means for producing a step signal in the absence of said new maximum speed command signal when said distance to be covered by said car is increased.

* * * * *